US007311024B1

(12) United States Patent
Piel

(10) Patent No.: US 7,311,024 B1
(45) Date of Patent: Dec. 25, 2007

(54) CUTTING BLADE REMOVAL TOOL

(76) Inventor: Donald D. Piel, 18016 Fairburn St., Hesperia, CA (US) 92345

( * ) Notice: Subject to any disclaimer, the term of this patent is extended or adjusted under 35 U.S.C. 154(b) by 0 days.

(21) Appl. No.: 11/729,413

(22) Filed: Mar. 28, 2007

(51) Int. Cl.
*B25B 7/02* (2006.01)
*B25B 5/00* (2006.01)

(52) U.S. Cl. ..... 81/418; 81/426

(58) Field of Classification Search ..... 81/367, 81/368, 418, 421, 426, 13, 186, 424.5; 269/257, 269/265, 291
See application file for complete search history.

(56) References Cited

U.S. PATENT DOCUMENTS 757,142 A * 4/1904 Parson ..... 81/13
3,498,157 A * 3/1970 McKillip ..... 76/80
4,617,710 A * 10/1986 Kotnik ..... 29/268
5,937,716 A * 8/1999 Klann ..... 81/419
6,772,658 B1 * 8/2004 Jasick ..... 81/418
2003/0005798 A1 * 1/2003 Kuchar ..... 81/426

* cited by examiner

*Primary Examiner*—David B Thomas
(74) *Attorney, Agent, or Firm*—Kenneth L Tolar

(57) ABSTRACT

A tool for assisting a user in removing machinery cutting blades includes an upper and a lower handle that operate and lock an upper movable jaw. A fixed jaw is secured to the lower handle. The upper movable jaw includes a prong for tightly engaging the top surface of a bolt, and a clamp member adjacent thereto for tightly engaging the upper surface of a machine blade. By manipulating the handles, a user can lock the upper jaw prong against the machine blade bolt allowing a user to remove a nut attached thereto.

6 Claims, 1 Drawing Sheet

CUTTING BLADE REMOVAL TOOL

CROSS REFERENCE TO RELATED APPLICATIONS

This application is entitled to and hereby claims the benefit of provisional application No. 60/478,148 filed on Jun. 12, 2003.

BACKGROUND OF THE INVENTION

1. Technical Field of the Invention

The present invention relates to a hand tool designed to assist a user in replacing cutting blades on power machinery.

2. Description of the Prior Art

Power machinery such as backhoes, scrapers, graders, bulldozers and similar equipment typically include removable cutting blades. The cutting blades are usually fastened to the equipment with recessed bolts and attached nuts. The blades eventually become worn or damaged and must be replaced. However, two workers are usually required to remove each nut and associated bolt-one to hold an object over the top of the bolt head to prevent it from rising out of its conforming recess and another to manipulate a tool to remove the nut.

Accordingly, there is currently a need for a device that allows a user to more easily remove and replace certain equipment blades. The present invention satisfies this need by providing a tool that allows an unassisted user to remove a machinery blade nut and bolt.

SUMMARY OF THE INVENTION

The present invention relates to a tool for allowing an unassisted user to remove machinery blade nuts and bolts. The device comprises an upper movable jaw and a lower stationary jaw. The upper jaw includes a distal end having a prong depending therefrom for tightly engaging the upper surface of a machinery blade bolt. Immediately adjacent the prong is a clamping member for tightly engaging the upper surface of the machinery blade. The upper movable jaw is pivotally secured to a lower handle member and a tensioning handle. The lower handle member includes a compression screw that adjusts the tension on the upper movable jaw. Attached to the tensioning handle is a release lever that allows a user to reopen the jaws once locked about an object.

It is therefore an object of the present invention to provide a tool that allows an unassisted user to remove machinery cutting blade bolts.

It is another object of the present invention to provide a tool that enhances safety associated with removing machinery cutting blades. Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
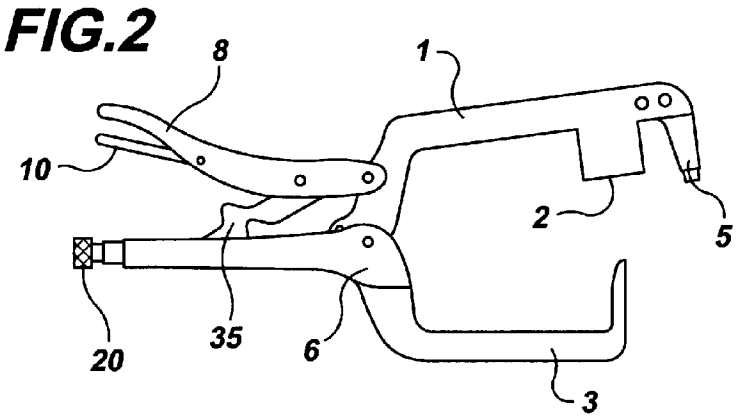
FIG. 2 is a side, plan view of the tool with the handles in an open position.
Figure 1:
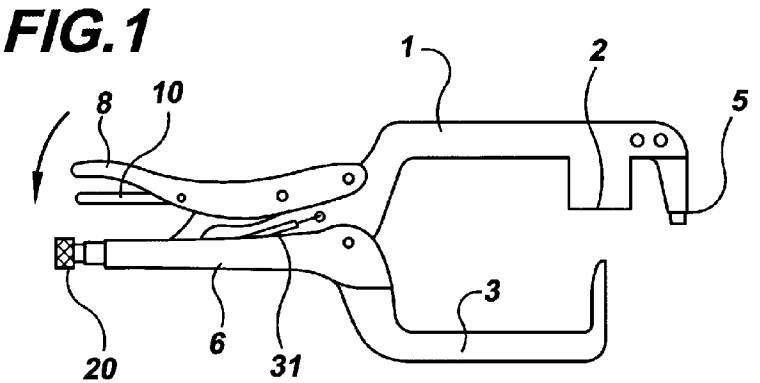
FIG. 1 is a side, plan view of the tool according to the present invention with the handles and cooperating jaws in a closed position.
Figure 4:
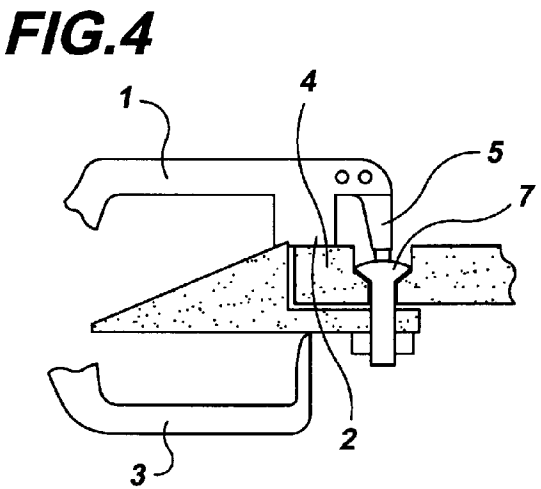
FIG. 4 is a partial side view of the tool engaging a cutting tool bolt.
Figure 3:
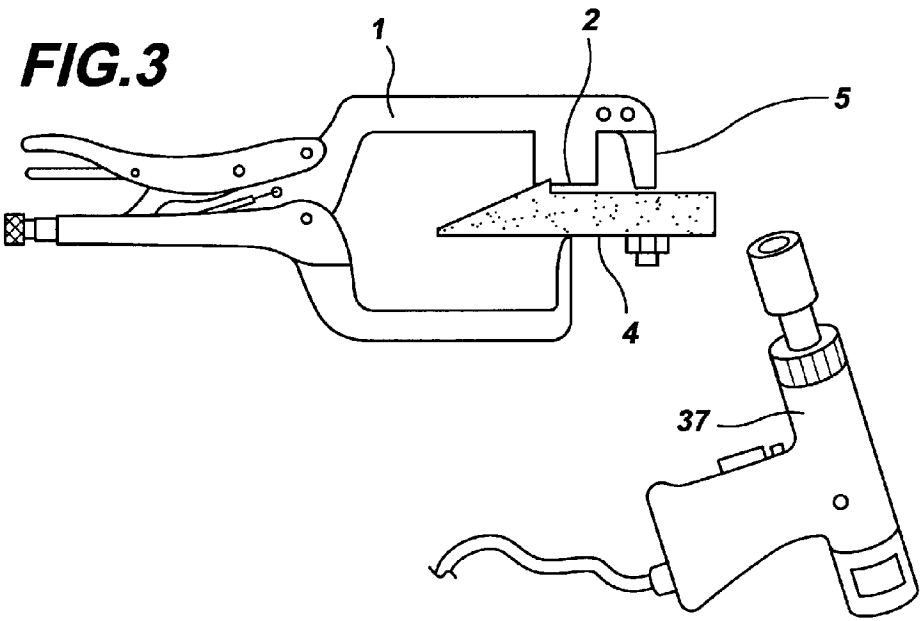
FIG. 3 is a side, plan view of the tool with the jaws engaging a cutting blade bolt.

The present invention relates to a tool for assisting a user in removing machinery blade nuts and bolts. The device comprises an upper movable jaw 1 and a lower stationary jaw 3. The upper jaw terminates at a distal end having a prong 5 depending therefrom for tightly engaging the upper surface of a machinery blade bolt 7. Immediately adjacent the prong is a clamping member 2 for tightly engaging the upper surface of the machinery blade 4. The upper movable jaw is pivotally secured to a lower handle member 6 and an upper, tensioning handle 8. The tensioning handle includes a release lever 10 that allows a user to reopen the jaws once locked about an object.

The lower jaw is fixedly secured to the lower handle member. The lower handle member includes a compression screw 20 that threadedly rides therein for adjusting the tension on the upper movable jaw. A brace member 35 interconnects the upper and lower handle members. A spring 31 opens the upper jaw when the release lever is depressed and also maintains pressure on an internal locking mechanism to maintain the upper jaw in a locked position. The above described handle-actuated locking mechanism is similar to that found on conventional locking pliers.

To use the above described device, a user sufficiently adjusts the upper jaw tension using the compression screw. The jaws are placed about the blade with the prong resting on top of the bolt head and the clamping member engaging the upper surface of the blade; the upper jaw is locked in such position by compressing the handles. With an impact wrench 37 or similar tool, the user can then easily remove the nut that is fastened to the bolt while the prong prevents the bolt head from rising out of its conforming recess. When finished, the user simply depresses the release lever and removes the tool from the blade.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cutting blade removal tool comprising:

a lower handle member;

a lower stationary jaw fixedly attached to the lower handle member;

an upper movable jaw pivotally secured to said lower handle member, said upper jaw including a distal end having a bolt engaging prong depending therefrom;

means for locking said jaws about an interposed object to prevent a bolt engaged by said prong from rising.

2. The tool according to claim 1 further comprising an adjustment means for applying a predetermined amount of tension to said movable jaw.

3. The tool according to claim 1 wherein said means for locking said jaws about an interposed object comprises a tensioning handle having a first end pivotally attached to said upper jaw which is depressed toward said lower handle member to lock said jaws about an interposed object.

4. The tool according to claim 2 wherein said adjustment means comprises a compression screw that threadedly rides within said lower handle member.

5. The tool according to claim 4 further comprising a release means for releasing said jaws once locked about an interposed object.

6. The tool according to claim 1 wherein said upper jaw further comprises a clamp member depending therefrom that is positioned adjacent said prong for engaging an upper surface of a cutting blade to anchor the upper jaw thereto.

* * * * *